United States Patent [19]

Newman, Sr. et al.

[11] Patent Number: 4,554,906

[45] Date of Patent: Nov. 26, 1985

[54] TANKLESS FRICTION BOILER SYSTEM

[76] Inventors: William E. Newman, Sr., 207 Doncaster Rd., Joppa, Md. 21085; Desmond J. Farrow, Sr., 546 Mechanics Valley Rd., North East, Md. 21901

[21] Appl. No.: 660,525

[22] Filed: Oct. 12, 1984

[51] Int. Cl.[4] ..... F22B 3/06

[52] U.S. Cl. ..... 122/26; 126/247

[58] Field of Search ..... 126/247; 122/26; 237/1 R; 188/264 D, 264 F, 264 CC

[56] References Cited

U.S. PATENT DOCUMENTS

| | | | |
|---|---|---|---|
| 540,833 | 6/1895 | Guillot | 126/247 |
| 1,718,175 | 6/1929 | Nilson | 122/26 |
| 4,312,322 | 1/1982 | Friehage | 126/247 |
| 4,387,701 | 6/1983 | Gibbons | 126/247 |

FOREIGN PATENT DOCUMENTS

| | | | |
|---|---|---|---|
| 2420 | 10/1853 | United Kingdom | 126/247 |

*Primary Examiner*—Randall L. Green

*Attorney, Agent, or Firm*—John F. McClellan, Sr.

[57] ABSTRACT

A friction boiler system has a rotary member frictionally engaging a housing having adjustable fit to the rotary member. The rotary member has a gray iron cover fixed on it and rotating with it. The housing is in two halves split longitudinally, each half has fixed therein a hemi-cylindrical liner of gray iron for fitting the circumference of the rotary member. To adjust the fit, a wedge on each side, driven by a screw-actuated cam, sets the spacing between the housing halves, against spring bias urging the housing halves together. The screw actuated cam has a straight portion guided by guideways and an angled portion inclined to the direction of wedge motion and riding in a recess in the respective wedge. A heat-transfer circulation system carries fluid heated by the frictional boiler system to point of use, and return, if a closed system is used. An electric motor may be employed as one form of power. Kinetic energy of other origins can be directly and efficiently converted to thermal energy by the system.

13 Claims, 3 Drawing Figures

TANKLESS FRICTION BOILER SYSTEM

FIELD OF THE INVENTION

Cross reference is made to our co-pending application Ser. No. 400,656, filed 7-22-82 for SYSTEM FOR POWERED FRICTIONAL APPARATUS, now abandoned.

BACKGROUND OF THE INVENTION

In the prior art, fluid cooled brakes and other frictional apparatus that produces heat have been disclosed, as well as the use of friction-produced heat to heat fluid for domestic and commercial use.

SUMMARY OF THE INVENTION

A principal object of the present invention is to provide an improved, economical, rotary heating system of the type that requires only electricity to run an electric motor, turning the rotary heating system without fume-producing consumption of fuel in the heater.

Further objects are to provide a system as described that employs only a few elements, of rugged construction, with easy adjustment and maintenance, and low cost of fabrication.

Yet further objects are to provide a system as described that is easy to install, that can heat-transfer using oil for high heats or water for low heats, and that can be made in large or small units, as desired, without design change.

Still further objects are to provide a system as described that is compact, durable, safe, quiet and that is relatively light in weight and easy to operate.

BRIEF DESCRIPTION OF THE DRAWINGS

The above and other objects and advantages of this invention will become more readily apparent on examination of the following description, including the drawings in which like reference numerals refer to like parts.

DETAILED DESCRIPTION

The heater mechanism shown is preferably symmetrical about the vertical centerplane, although redundant parts are omitted in the showings for clearer exposition.

Figure 1:
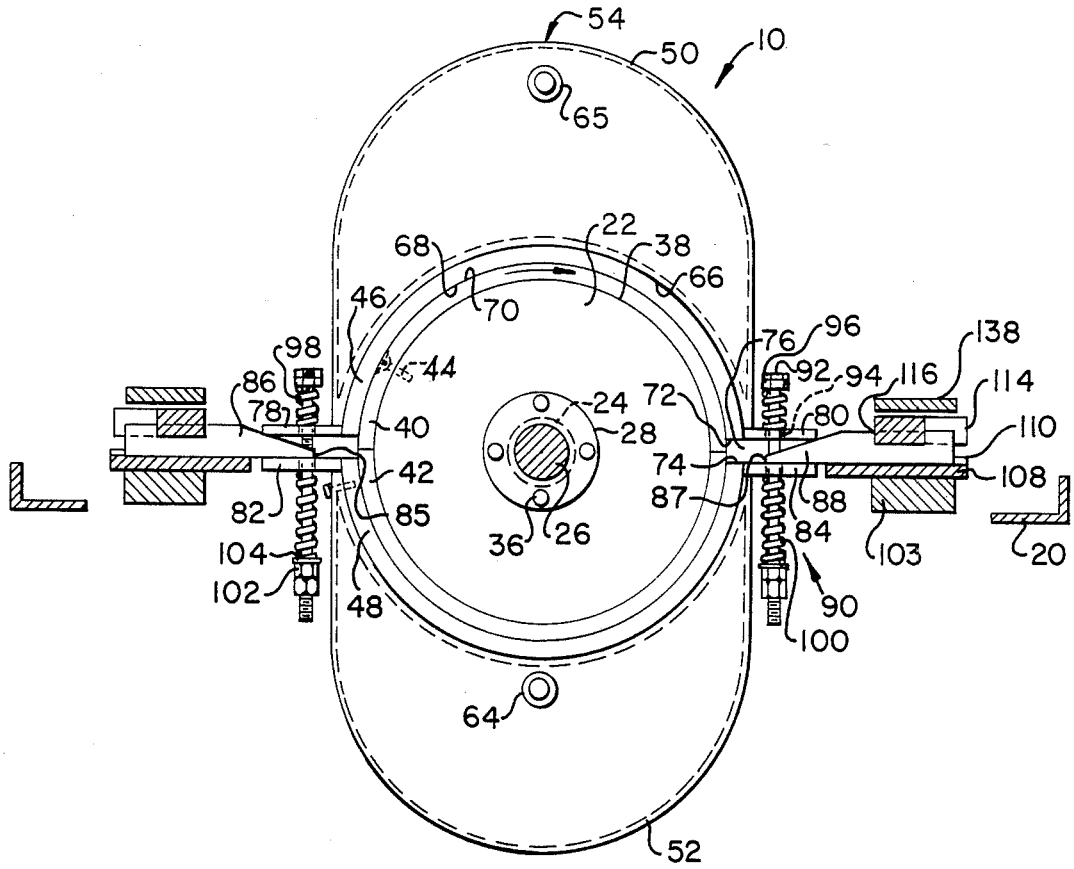
FIG. 1 is an end elevational fragmentary view of a preferred embodiment of the invention.
Figure 2:
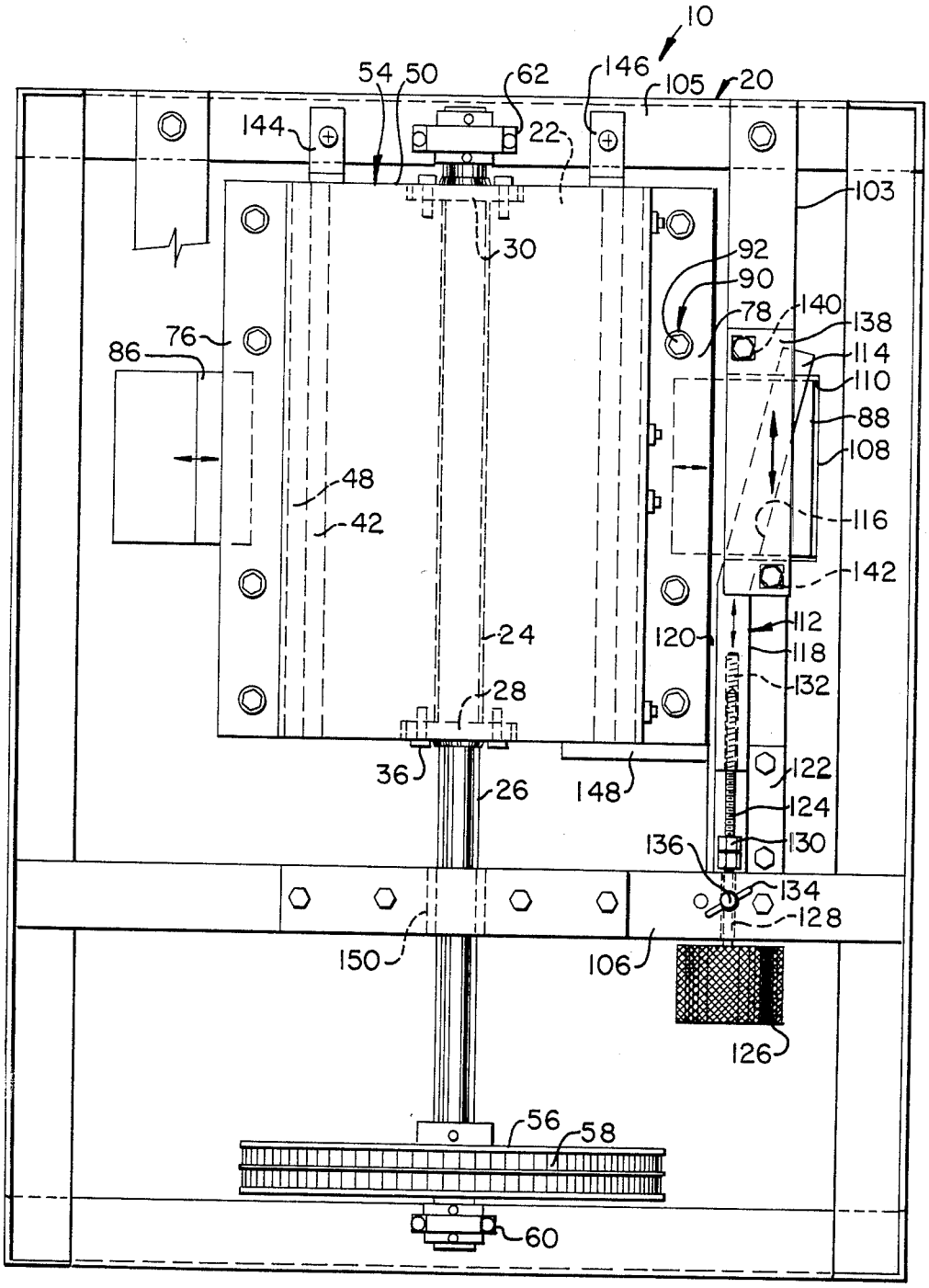
FIG. 2 is a top plan fragmentary detail.

FIGS. 1 and 2 show the invention in embodiment 10.

A frame 20 shown, supports all elements of the invention.

Major elements include a gray iron cylindrical rotor or drum 22, made massive and substantially solid for storing heat. The rotor has a bore 24 through which a shaft 26 passes. The bore 24 in the rotor is larger than the shaft. Welded to the shaft are round plates 28, 30, one at each end, with machine screws 36 to secure the plates 28, 30 centrally to the rotor 22.

The rotor 22 has a covering on the cylindrical surface 38 in the form of two hemi-cylindrical gray iron cover members 40, 42 held to it by countersunk bolts, 44 shown.

These members are part of the means for producing frictional heat, and compensating wear. They rotate in adjustable contact relative to a fixed assembly as a means for producing frictional heat: a respective generally hemi-cylindrical gray iron liner 46, 48 or bore portion in each half 50, 52 of housing assembly 54.

To produce the relative rotation, the housing halves have means on the sides and ends to affix it adjustably to the frame, and an electric motor to rotate the shaft 26 by means of sprocket 56 and chain 58. Alternatively a pulley and belt arrangement can be used.

A pillow block 60 rotatably supports the first end of the shaft 26 to the frame 20 and similarly a second pillow block 62 supports the second end of the shaft to the frame.

As noted, the rotor 22 makes adjustable frictional contact within the housing to produce frictional heating. Each of the upper and lower halves 50, 52 is a reservoir for liquid to be heated by the frictional heat. Suitable connections 64 and 65 shown, serve to circulate the heated liquid to locations where used. For the purpose of heating the liquid the housing has a cylindrical bore 66 closely fitting the hemi-cylindrical gray iron members 46 and 48 in which the rotor 22 runs. The frictional interface of the members may be referred to as the gray iron bore 68 and the gray iron drum 70.

Fit of the gray iron bore 68 to the gray iron drum 70 is adjustable and, to an extent, self-adjusting thereafter to adjust heating produced and to accommodate wear. The hemi-cylinders 46, 48 forming the bottom and the top of the bore have on each side longitudinal, opposed edges 72, 74. These edges of the upper hemi-cylinder and of the lower hemi-cylinder, have a space 76 between them on each side so that they do not meet. Each space may be about one inch (2.5 cm) wide. These spaces provide for adjustment of the contact beteen the gray iron bore 68 and the gray iron drum 70.

The adjustment is provided as follows.

The upper one of the housing halves 50 has on each side respective longitudinal laterally protrusive flange 78, 80 and these are opposed vertically by similar longitudinal flanges 82, 84 with a spacing 85, 87 between. These spacings may be the same as the spacings 76 between the hemi-cylindrical gray iron liners.

Adjustment for the spacings 76 and therefore for the fit between the gray iron drum 70 and the gray iron bore 68 is by means of a wedge 86, 88 on each side between the flanges 78, 82 and 80, 84. The top of each wedge is beveled, the bottom generally horizontal. The wedges act against the resilient bias of spring assemblies 90. Four spring assemblies on each side suspend the lower housing half below the upper housing half. In these, vertical bolts 92 pass through respective oversize holes 94 in the flanges.

Under the head of each bolt a washer 96 compresses a first spring 98 against a flange 78, 80 of the upper housing half. Opposing this, retained on the threaded end of each bolt is a second spring 100. Two nuts 102, acting through washers 104, adjust the compressive force (change the bias) exerted against the wedges 86, 88 by the flanges and therefore the frictional force exerted between the gray iron drum 70 and gray iron bore 68.

The wedges support the entire housing assembly, to some extent with the rotor, to the frame 20, acting through the adjustment provisions; 85, 87 on the ends of the wedges.

To adjust or urge the wedges 86, 88 in or out between the flanges 78, 80, 82, 84 each wedge has the following parts associated with it.

Below each wedge a respective horizontal support 103 extends from transverse frame member 105 to transverse frame member 106. Screwed or otherwise conventionally affixed on the frame member is a guideway 108 with a transverse slot 110 in which the generally rectangular-section body of the wedge rides in or out, as adjusted.

A bar 112 has an outwardly angled cam portion 114 riding in an outwardly inclined slot 116 in the top of the wedge, and a longitudinal cam portion or straight shank portion 118 guided between parallel-spaced fixed members 120 and 122. An adjustment screw 124 with knurled knob 126 is held captive in a clearance hole 128 in frame transverse member 106 by the knurled knob 126 on one side and jam nuts 130 on the other.

The threaded end of the adjustment screw 124 engages a tapped hole 132 in the straight shank portion 118 and thrusts it longitudinally to adjust the wedge 88 in or out. A thumb screw 134 passing through transverse member 106 bears on and locks the adjusting screw when desired. A hole 136 axially through the thumb screw provides for lubricating the bearing of the adjusting screw in the transverse member. Top plate 138 bolted to blocks 140, 142 retains the top of bar 114 with a slight clearance to prevent the bar and wedge from rising.

Adjustable stops 144, 146, 148 on the frame 20 define the axial position of the housing. Bridge structure 150 permits shaft 26 to clear transverse member 106.

Adjustment is as follows:

1. By adjusting the wedges in or out bring the upper housing half down to contact the rotor, with desired pressure.
2. Manually lift the bottom or lower housing to touch the rotor.
3. Tighten the spring-assembly nuts manually.
4. Jam the nuts together to lock them.

Figure 3:
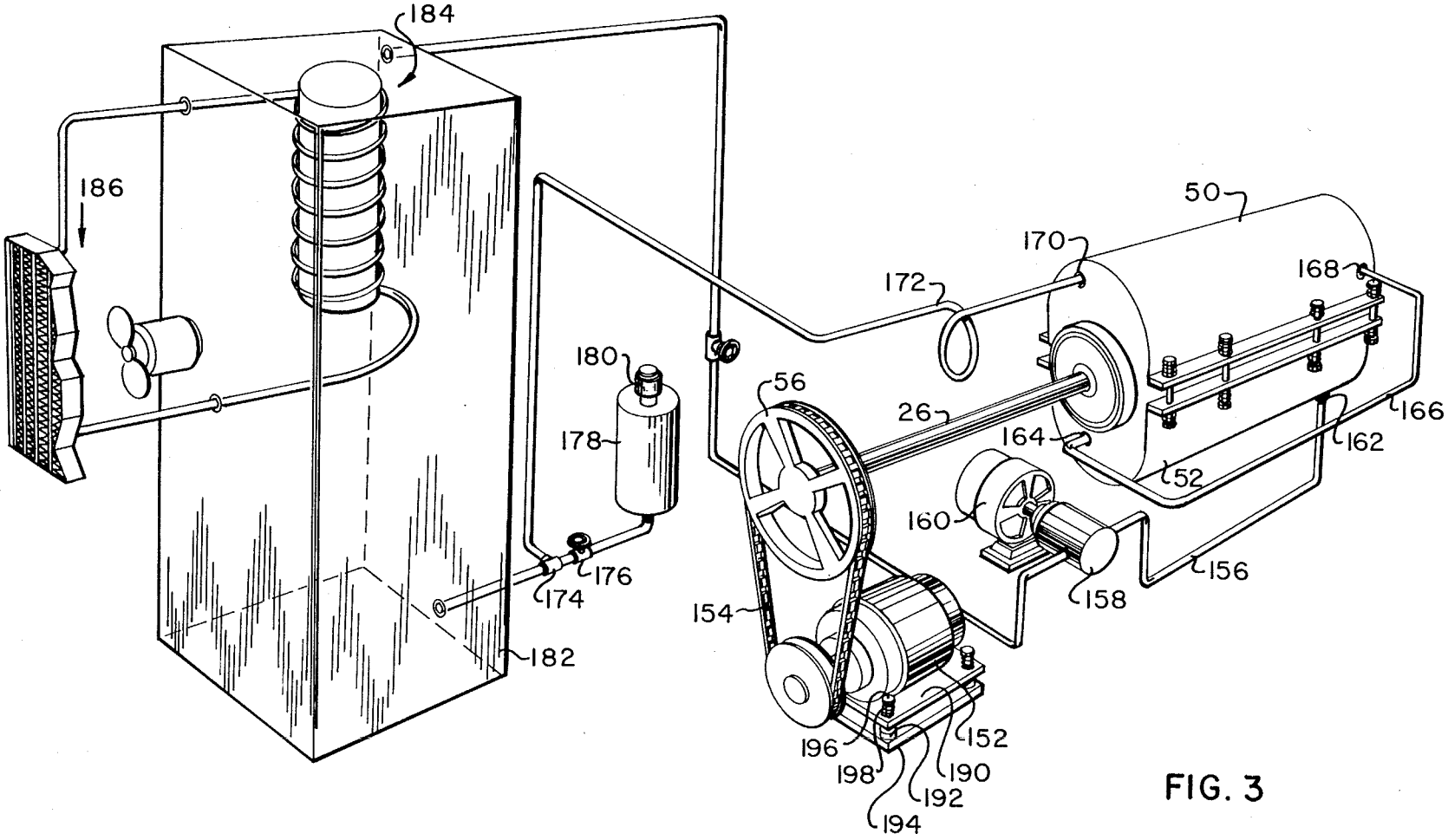
FIG. 3 is a perspective diagram to show associated equipment and hook-up.

FIG. 3 diagrams a typical circulatory arrangement for the system to expose fluid to the fixed assembly for heating.

Electric motor 152 and endless drive 154 for driving the sprocket 56 and shaft 26 appear here (as noted, a belt drive can be used).

For exposition, the upper housing and lower housing 50, 52 are shown diagrammatically, the frame is omitted, and the wedges and wedge drive are omitted.

Oil or other fluent material such as other liquid usually employed for heat transfer is pumped through a flexible tubing 156 by a typical pump 158 driven by a motor 160, into the bottom of an end of the lower housing 52 at connection 162. From there it emerges partially heated at connection 164 at the other end and through a flexible tubing 166 enters the lower portion of the upper housing 50 at connection 168. It then, as before, passes through the length of the upper housing 50 and emerges at connection 170, from where it passes through flexible tubing 172 to "T" connection 174.

Valve 176 when open admits the liquid to an expansion tank 178 which has a relief valve 180 at the upper end. In the opposite direction the "T"-connection leads to any suitable tank 182 from which it may be drawn for use and resupplied by any conventional hot water piping system (not shown) or may be used in any suitable heat exchanger mode through a typical coil arrangement 184 to supply an air conditioning system 186 or a hot air exchanger, with conventional fan and other elements usually employed, not shown, except for a radiator portion.

The system operates quietly and smoothly, and to insure minimum vibration, the electric motor 152 has a plate 190 mounted to it with at each corner of the plate a rubber buffer 192 secured to a base 194 by a headed bolt 196 with a spring 198 biasing the plate down.

It will be appreciated that a commercial size embodiment of the invention is described here, being about 16 inches (0.4 meter) long with other dimensions shown to the same scale. The length of each hemi-cylindrical liner and drum portion may be half this for home installation.

This invention is not to be construed as limited to the particular forms disclosed herein, since these are to be regarded as illustrative rather than restrictive. It is, therefore, to be understood that the invention may be practiced within the scope of the claims otherwise than as specifically described. For example, it will be appreciated that instead of the electric motor, kinetic energy from wind or water can be converted directly into heat, using this invention.

What is claimed and desired to be protected by United States Letters Patent is:

1. In a system for heating fluent material by heat caused by the biased contact of a rotor and and assembly fixed relative thereto; the improvement comprising: the rotor being cylindrical, the fixed assmebly including: a first member with a hemi-cylindrical bore portion, a second member with a hemi-cylindrical bore portion and a plurality of elements for adjustably holding the first member relative to the second member, said plurality of elements compensating for wear caused by frictional contact between the rotor and the first and second hemi-cylindrical bore portions by resiliently suspending the second member below the first member with the hemi-cylindrical bore portions opposed to form a substantially cylindrical bore and causing said hemi-cylindrical bore portions to be urged toward said rotor, means for rotating the rotor in the substantially cylindrical bore in contact with the first and second members, means affixing said assembly against rotation, and means associated with the first and second member for exposing fluid for heating by said assembly.

2. In a system as recited in claim 1, the plurality of elements including: the first and second members having respective longitudinal flange portions on each side respectively and being in spaced opposition to one another, and a respective wedge between each set of opposed longituinal flange portions with a part thereof supporting each longitudinal flange portion of the first member, and means for selectively urging the wedges in directions toward, or away from, said longitudinal flange portions for changing the spacing of said opposed longitudinal flange portions.

3. In a system as recited in claim 2, said plurality of elements including a plurality of springs, biasing together the first and second members.

4. In a system as recited in claim 3, said plurality of elements further including means associated with the plurality of springs for changing the bias of the plurality of springs.

5. In a system as recited in claim 4, wherein said plurality of elements including the means for changing the bias comprising a plurality of vertical bolts with nuts, respectively mounting the plurality of springs.

6. In a system as recited in claim 5, each vertical bolt having a respective first said spring on the upper end thereof above a said longitudinal flange portion of the first member, and a respective second said spring on the lower end thereof below a said longitudinal flange portion of the second member and above at least one said nut on the bolt.

7. In a system as recited in claim 2, each wedge having a substantially horizontal lower side, and a beveled upper side at said part supporting a longitudinal flange portion.

8. In a system as recited in claim 7, the means for selectively urging the wedges including a screw, a longitudinal cam portion responsive to screwing of the screw, and a laterally inclined cam portion on the longitudinal cam portion and engaging a slot in a wedge.

9. In a system as recited in claim 2, a cover on the rotor in the form of two hemi-clindrical cover portions, and said hemi-cylindrical bore portions including a hemi-cylindrical liner.

10. In a system as recited in claim 9, said cover and hemi-cylindrical liners being of gray iron.

11. In a system as recited in claim 2, the means for rotating the rotor including a motor, a shaft for connecting the motor with the rotor and means for holding the shaft on the axis of rotor rotation, including the rotor having a bore larger than the shaft, a respective plate on the shaft at each end of the substantially cylindrical bore, and means for fixing the plates centrally to the rotor.

12. In a system as recited in claim 2, the means for exposing fluid for heating including a respective fluid container integral with each of said first and second members, and a system for passing fluent material through the fluid containers in sequence.

13. In a system as recited in claim 12, said fluid containers being hemi-cylindrical in shape in general conformation with said hemi-cylindrical bore portions.

* * * * *